US005350156A

United States Patent [19]

Coté et al.

[11] Patent Number: 5,350,156

[45] Date of Patent: Sep. 27, 1994

[54] MECHANICAL CONNECTION DEVICE FOR ASSEMBLING A RAILING

[76] Inventors: Ravnald Coté, 40, des Bouleaux; Victor Coté, 2, de L'entre-deux, both of St-Apollinaire, Québec, Canada, G0S 2E0

[21] Appl. No.: 34,814

[22] Filed: Mar. 19, 1993

[51] Int. Cl.[5] ..... E04H 17/00

[52] U.S. Cl. ..... 256/65; 256/59; 256/69

[58] Field of Search ..... 256/65, 69, 70, 60, 256/59, 23, 24; 403/374, 409.1

[56] References Cited

U.S. PATENT DOCUMENTS

| | | | |
|---|---|---|---|
| 1,070,814 | 8/1913 | Kimball | 256/65 |
| 1,125,670 | 1/1915 | Duke | 403/409.1 |
| 3,129,965 | 4/1964 | Stark | 256/65 |
| 3,529,808 | 9/1970 | Siebers | 256/65 |
| 4,167,355 | 9/1979 | Hansson | 403/409.1 |
| 4,540,309 | 9/1985 | Hansson | 403/374 |
| 4,809,955 | 3/1989 | Veilleux . | |
| 4,898,365 | 2/1990 | Conner et al. | 256/65 |
| 4,919,394 | 4/1990 | Otte et al. . | |
| 4,923,176 | 5/1990 | Heinz . | |
| 4,953,830 | 9/1990 | Weaver, III . | |
| 4,986,513 | 1/1991 | Schultz et al. . | |
| 5,136,770 | 8/1992 | Kenngott | 256/65 |

FOREIGN PATENT DOCUMENTS

| | | |
|---|---|---|
| 1090639 | 12/1980 | Canada . |
| 1131480 | 9/1982 | Canada . |
| 1213767 | 11/1986 | Canada . |
| 1306633 | 8/1992 | Canada . |

*Primary Examiner*—Randolph A. Reese
*Assistant Examiner*—Anthony Knight

[57] ABSTRACT

A device for connecting, in a railing, one end of an elongated rail to a hollow, tubular and vertical post formed with an horizontal slot therein. The device is flat and comprises an elongated body to be screwed to the end of the rail, and a head to be inserted in the slot to extend at least partially inside the hollow post. The head comprises an outer semicircular edge surface, and is formed with a hole defining an inner semicircular edge surface concentric with the outer edge surface. A screw is mounted in the hole with its head applied to the inner surface of the hollow post, and with its threaded elongated body applied to both the inner surface of the post and the inner semicircular edge surface. The screw secures, from the inside of the hollow post, and flat head in the slot and the therefore the end of the rail to the post.

16 Claims, 3 Drawing Sheets

MECHANICAL CONNECTION DEVICE FOR ASSEMBLING A RAILING

BACKGROUND OF THE INVENTION

1. Field of the Invention

The present invention relates to a device for mechanically connecting, in a railing, the horizontal and/or slanted rails to the vertical posts.

2. Brief Description of the Prior Art

Many prior art devices have been proposed to secure the ends of the horizontal and/or slanted rails to the adjacent vertical posts.

These prior art devices include conventional L-shaped brackets screwed both to the rail and post. These brackets are usually apparent to affect the aesthetic of the railing- Also, they frequently become loose; this results into a railing lacking stiffness.

U.S. Pat. No. 4,923,176 (Heinz) issued on May 8, 1990, and U.S. Pat. No. 4,986,513 granted to Schultz et al. on Jan. 22, 1991 disclose connector brackets for attaching the ends of rails to adjacent posts while allowing selected orientation of a rail relative to a connector bracket and a post on which the latter bracket is installed. A drawback of these prior art connector brackets is that they are apparent and affect the aesthetic of the resulting railing.

OBJECT OF THE INVENTION

An object of the present invention is therefore to provide a non apparent device for connecting, in a railing, one end of a rail member to a hollow post.

SUMMARY OF THE INVENTION

More specifically, in accordance with the present invention, there is provided a device for connecting one end of a generally elongated member to a hollow member formed with an opening therein, comprising a first section to be secured to the end of the elongated member, and a second section to be inserted in the opening of the hollow member so that this second section extends at least partially inside that hollow member. The second section also comprises means for enabling, from the inside of the hollow member, securement of the second section in the opening and therefore securement of the end of the elongated member to the hollow member.

Also in accordance with the present invention, there is provided a device for connecting, in a railing, one end of a generally elongated rail member to a hollow post formed with an opening therein, comprising a first section to be secured to the end of the rail member, and a second section to be inserted in the opening so that this second section extends at least partially inside that hollow post. The second section further comprises means for enabling, from the inside of the hollow post, securement of the second section in the opening and therefore securement of the end of the rail member to the hollow post.

The present invention further relates to a system for connecting one end of a generally elongated member to a hollow member, comprising an opening in the hollow member, a connection device and a fastener. The connection device includes (a) a first section secured to the end of the elongated member, and (b) a second section inserted in the opening to extend at least partially inside the hollow member, this second section comprising fastener receiving means situated inside the hollow member. The fastener is mounted in the fastener receiving means for securing the second section in the opening and therefore the end of the elongated member to the hollow member.

The present invention is still further concerned with a system for connecting, in a railing, one end of a generally elongated rail member to a hollow post, comprising an opening in the hollow post, a connection device and a fastener. The connection device includes (a) a first section secured to the end of the rail member, and (b) a second section inserted in the opening to extend at least partially inside the hollow post, this second section comprising fastener receiving means situated inside the hollow post. The fastener is mounted in the fastener receiving means for securing the second section in the opening and therefore the end of the rail member to the hollow post.

As its second section is inserted in the opening of the hollow member or post and is secured from the inside of that hollow member or post, the device according to the invention can be easily hidden to preserve the aesthetic appearance of the railing.

In accordance with a preferred embodiment of the invention, the opening is a slot, and the second section is flat to fit in this slot, comprises an outer semicircular edge surface, and is formed with a hole defining an inner semicircular edge surface concentric with said outer semicircular edge surface.

In accordance with another preferred embodiment of the invention, a screw having a head and a threaded elongated body is mounted in the hole of the second section with its head applied to an inner surface of the hollow member or post, and with its threaded elongated body applied to both the inner surface of the hollow member and the inner semicircular edge surface. The second section is thereby firmly secured in the slot of the hollow member. Also, the slot, the outer and inner semicircular edge surfaces and the screw enable fast and precise connection of the elongated member to the hollow member.

In accordance with further preferred embodiments of the subject invention, the second section is made of a material that can be bent to give to the elongated member the desired orientation, the first section is elongated and flat and comprises longitudinal slots for screwing it to the end of the elongated member, and the first and second sections are flat and the device is a one-piece device stamped from a metal plate.

The objects, advantages and other features of the present invention will become more apparent upon reading of the following non restrictive description of preferred embodiments thereof, given by way of example only with reference to the accompanying drawings.

BRIEF DESCRIPTION OF THE DRAWINGS

In the appended drawings

DETAILED DESCRIPTION OF THE PREFERRED EMBODIMENT

Although the preferred embodiment of the present invention will be described in relation to a railing, it should be kept in mind that other applications can be envisaged.

Figure 1:
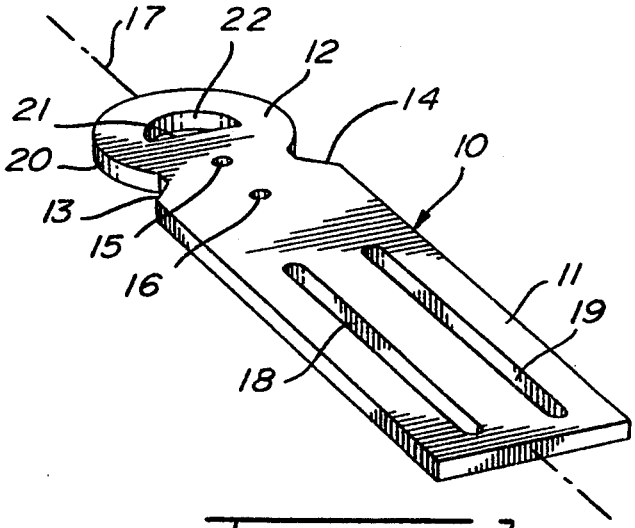
FIG. 1 is a perspective view of a device according to the invention, for connecting in a railing one end of an elongated rail to a hollow post formed with an horizontal slot therein.

The preferred embodiment of the device according to the present invention is illustrated in FIG. 1 and generally identified by the reference 10 throughout the accompanying drawings. This device 10 is flat and formed with first and second sections. The first section comprises an elongated body 11 while the second section comprises a head 12.

The elongated body 11 is generally rectangular and defines a pair of slanted shoulders 13 and 14. Two holes 15 and 16 are drilled through the elongated body 11, the axes of these holes 15 and 16 being perpendicular to and intersecting the longitudinal axis 17 of the device 10. The elongated body 11 is further provided with a pair of longitudinal slots 18 and 19 symmetrical about the longitudinal axis 17.

The head 12 comprises a semicircular edge surface 20 and a half-moon shaped hole 21 defining a semicircular inner edge surface 22. The semicircular edge surfaces 20 and 22 are concentric and present a symmetry about the longitudinal axis 17 of the device 10.

The flat device 10 is advantageously produced at low cost by stamping an aluminum plate, for example a 3 mm thick aluminum plate.

Figure 2:
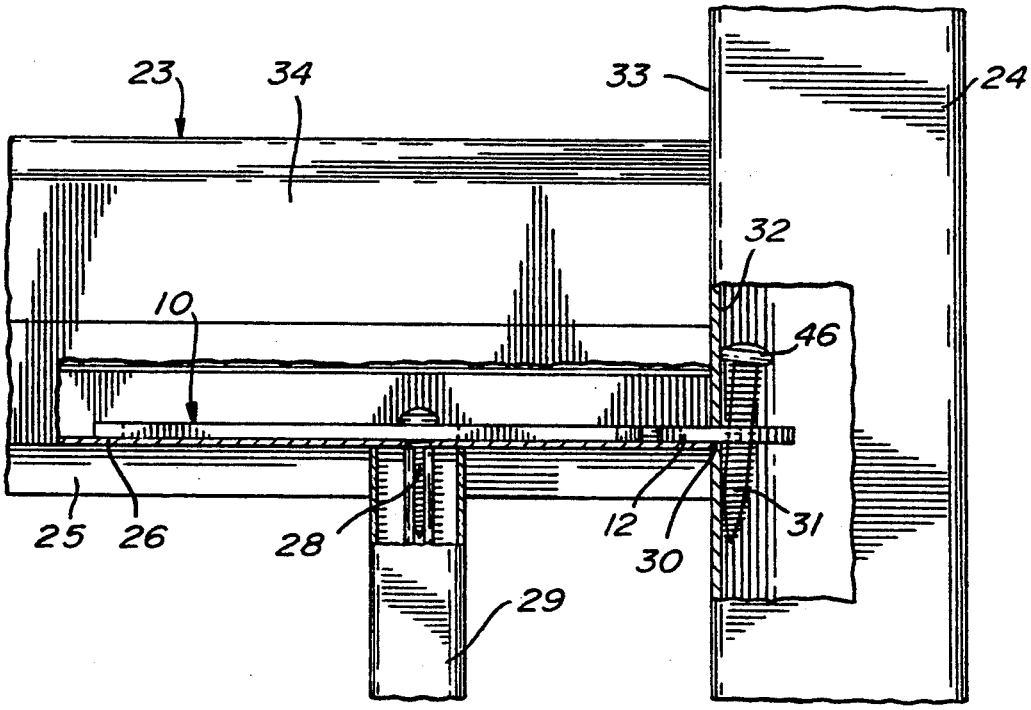
FIGS. 2 and 3 are respectively side elevational and top plan view of a first example of assembly of one end of an elongated rail to a hollow post by means of the device of FIG. 1.
Figure 3:
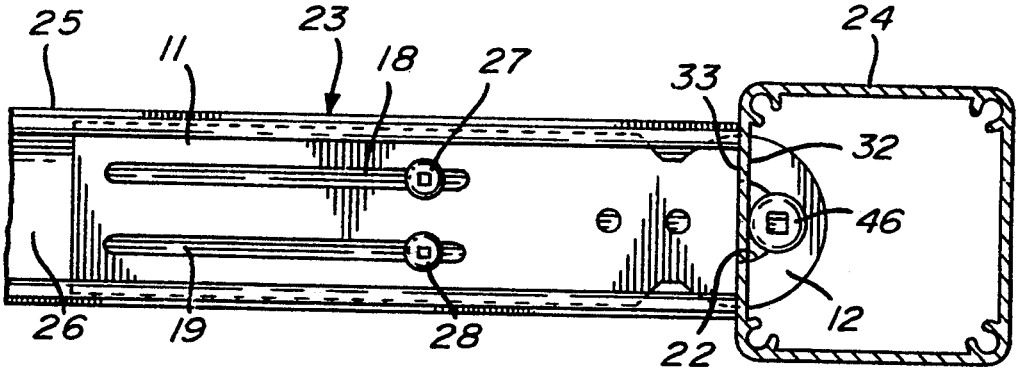

The example of FIGS. 2 and 3 of the appended drawings shows one end of an horizontal, elongated handrail 23 connected to a hollow, tubular and vertical post 24 of an aluminum railing by means of a device 10 as illustrated in FIG. 1. As can be seen in FIG. 3, the post 24 has a square cross section.

The elongated body 11 of device 10 is first secured to the handrail 23. This handrail 23 comprises a lower longitudinal portion 25 having a U-shaped cross section and a flat bottom wall 26. The width of the elongated body 11 is selected to fit between the vertical walls of the U-shaped handrail portion 25 when applied on the top face of the flat bottom wall 26. The width and position of the slots 18 and 19 are selected to allow passage of the screws 27 and 28 fixing the upper end of a baluster 29 closer to the hollow post 24. More specifically, the screws 27 and 28 pass through the slots 18 and 19, through corresponding holes (not shown) drilled in the bottom flat wall 26 and are driven into the upper end of the baluster 29. As well known in the art of aluminum railing, the baluster 29 is made of an aluminum extrusion shaped to receive the screws 27 and 28.

As can be appreciated, the screws 27 and 28 will secure the body 11 to the lower handrail portion 25 while fixing the upper end of the baluster 29 to that handrail portion 25. The slots 18 and 19 provide for longitudinal adjustment of the position of the body 11 on the handrail portion 25 to enable correct positioning of the head 12 of the device 10. This adjustment is required as the distance between the post 24 and baluster 29 may vary.

An horizontal slot 30 is then made in the wall of the post 24, and the portion of head 12 extending from the end of the handrail portion 25 is inserted in this slot 30. A screw 31 is then mounted in the hole 21 of the head 12 with its head 46 applied to the inner surface 32 of the hollow post 24, and with its threaded elongated body applied to both the inner surface 32 and the inner semicircular edge surface 22 of the head 12. The screw 31 is screwed until the end of the handrail lower portion 25 is applied to the outer surface 33 of the post 24. Indeed, the screw 31 in combination with the edge surface 22 produce a pulling force that firmly applies the end of handrail portion 25 to the outer surface 33 of the post 24. Therefore, the screw 31 and the semicircular edge surface 22 enable securement, from the inside of the post 24, of the head 12 in the slot 30 to thereby secure the end of the handrail portion 25 to the post 24.

As the end of the lower handrail portion 25 is cut perpendicular to the longitudinal axis of that handrail portion, the latter extends perpendicular to the post 24.

The last step consists of press fitting an upper longitudinal portion 34 of the handrail 23 on the lower handrail portion 25 as well known to those skilled in the art of aluminum railings.

Figure 4:
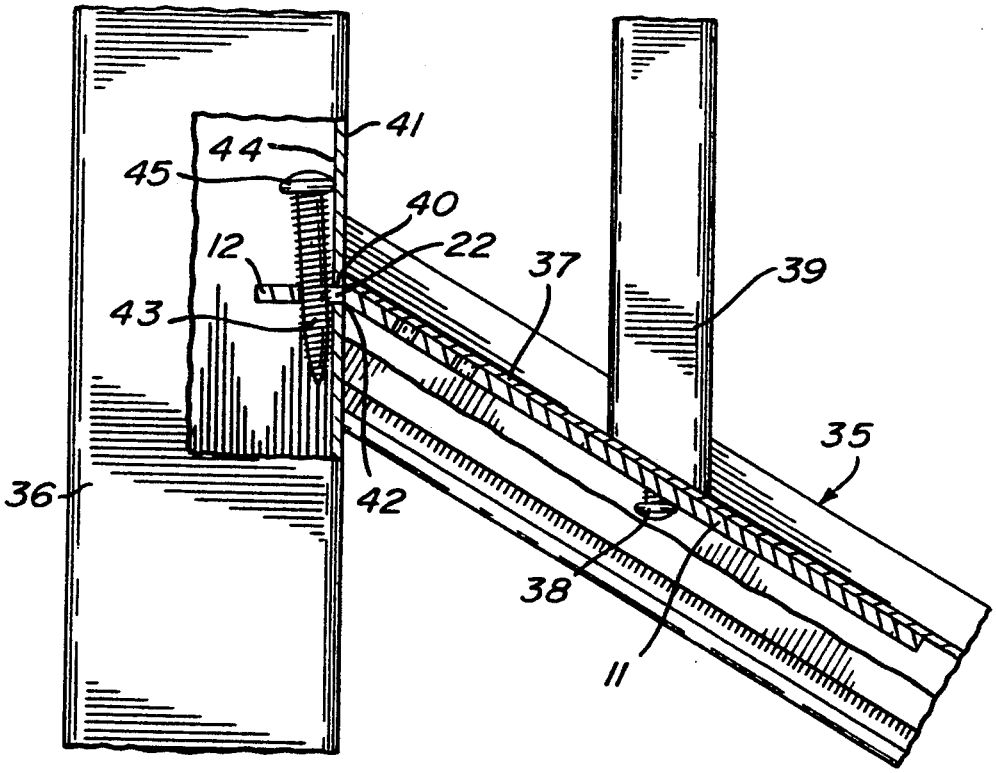
FIG. 4 is a side elevational view of a second example of assembly of one end of an elongated rail to a hollow post by means of the device of FIG. 1.

FIG. 4 is an example in which one end of a lower, slanted rail 35 is connected to a hollow, tubular and vertical post 36 square in cross section. This example corresponds to an aluminum railing of stairs, in which post 36 is located at the upper end of the stairs. Again, a device 10 as illustrated in FIG. 1 is used.

The elongated body 11 of device 10 is first secured to the lower, slanted rail 35. This rail comprises a flat top wall 37 and a cross section having the shape of an inverted "U". The width of the elongated body 11 is selected to fit underneath the flat top wall 37 between the two vertical walls of the U-shaped rail 35. The width and position of the slots 18 and 19 are selected to enable passage of a pair of screws such as 38 fixing the lower end of a baluster 39 to the rail 35. More specifically, the screws such as 38 pass through the slots 18 and 19 and through corresponding holes (not shown) drilled in the top flat wall 37, and are driven in the lower end of the baluster 39. As well known in the art of aluminum railings, the baluster 39 is made of an aluminum extrusion structured to receive the screws such as 38.

Accordingly, the screws such as 38 will secure the elongated body 11 to the rail 35 while fixing the lower end of the baluster 39 to that rail. As can be appreciated, the slots 18 and 19 provide for longitudinal adjustment of the position of the body 11 on the rail 35 whereby the head 12 can be positioned as required to connect the end of the rail 35 to the post 36. This adjustment is required as the distance between the post 36 and the baluster 39 may vary.

An horizontal slot 40 is then made in the wall of the post 36. As the lower rail 35 is slanted, its end is cut obliquely with respect to its longitudinal axis to fit on the outer surface 41 of the post 36. The head 12 is bent at 42 to orient the portion of this head 12 extending from the corresponding end of the rail 35 perpendicular to this obliquely cut end. This portion of head 12 is then inserted in the slot 40, and a screw 43 is mounted in the hole 21 of the head 12 with its head 45 applied to the inner surface 44 of the hollow post 36, and with its threaded elongated body applied to both the inner surface 44 and the inner semicircular edge surface 22 of the head 12. The screw 31 is screwed until the obliquely cut end of the rail 35 is applied to the outer surface 41 of the post 36. Indeed, the screw 43 in combination with the edge surface 22 produces a pulling force that firmly applies the obliquely cut end of the rail 35 to the outer surface 41 of the post 36.

As the end of the rail 35 is cut obliquely with respect to the longitudinal axis of that rail, the rail 35 extends obliquely from the post 35.

Figure 5:
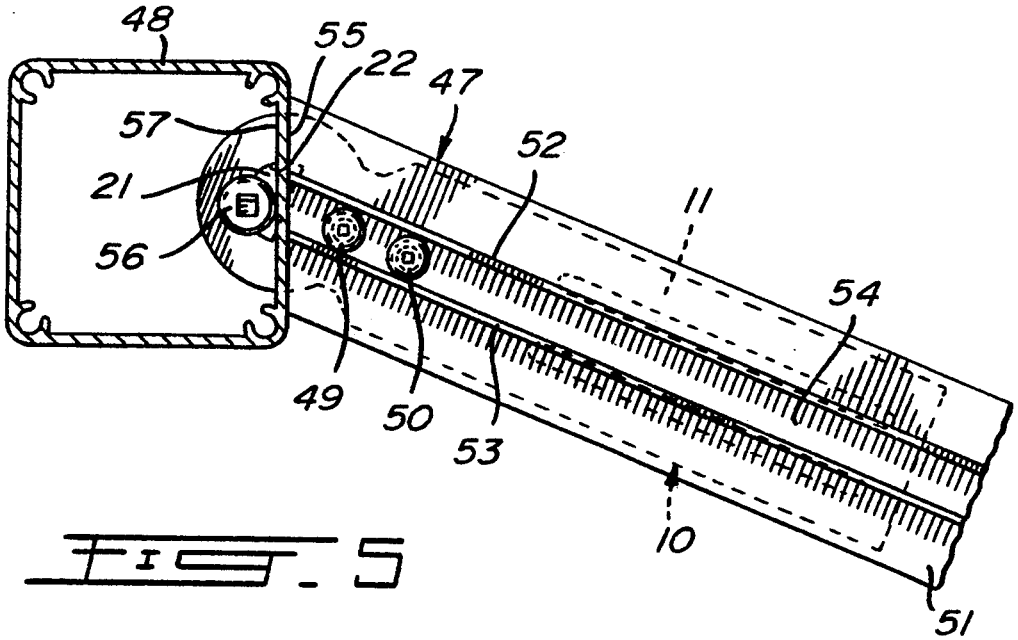
FIG. 5 is a top plan view of a third example of assembly of one end of an elongated rail to a hollow post by means of the device of FIG. 1.

FIG. 5 is a further example in which one end of a rail 47 of an aluminum railing is connected to a hollow, tubular and vertical post 48, square in cross section, of the same railing. A device 10 as illustrated in FIG. 1 is still used to carry out this connection.

The elongated body 11 of device 10 is first secured to the rail 47 by means of a pair of screws 49 and 50. The rail 47 comprises a flat top wall 51 and a cross section having the shape of an inverted "U". The rail 47 is also formed, on the upper surface of the top wall 51, with a pair of parallel flanges 52 and 53 defining a longitudinal channel 54 for receiving the edge portion of a plate of tempered glass (not shown), used in the art of aluminum railing to replace the balusters. The width of the elongated body 11 is selected to fit underneath the flat top wall 51 between the vertical walls of the rail 47. Holes (not shown) are drilled in the flat top wall 51 in the bottom of channel 54, and the screws 49 and 50 are inserted in these holes and respectively driven in the holes 15 and 16 to secure the body 11 to the rail 47.

An horizontal slot (not shown) is then made in the wall of the post 48. The end of the rail 47 is cut obliquely with respect to its longitudinal axis so that when the obliquely cut end of the rail 47 is applied on the outer surface 55 of the post 48, the rail 47 is lying in an horizontal plane but extends obliquely from the outer surface 55 of the square post 48. The portion of the head 12 extending from the corresponding end of the rail 47 is then inserted in the slot, and a screw 56 is then mounted in the hole 21 of the head 12 with the screw's head applied to the inner surface 57 of the hollow post 48, and with its threaded elongated body applied to both the inner surface 57 and the inner semicircular edge surface 22 of the head 12. The screw 31 is screwed until the obliquely cut end of the rail 47 is applied to the outer surface 55 of the post 48. Indeed, the screw 56 in combination with the edge surface 22 produces a pulling force that firmly applies the obliquely cut end of the rail 47 to the outer surface 55 of the post 48.

As shown in FIG. 5, the semicircular edge surfaces 20 and 22 allow the head 12 to automatically adapt to the oblique orientation of the rail 47. As the outer edge surface 20 is semicircular over more than 180°, relatively sharp oblique orientations are enabled.

Figure 6:
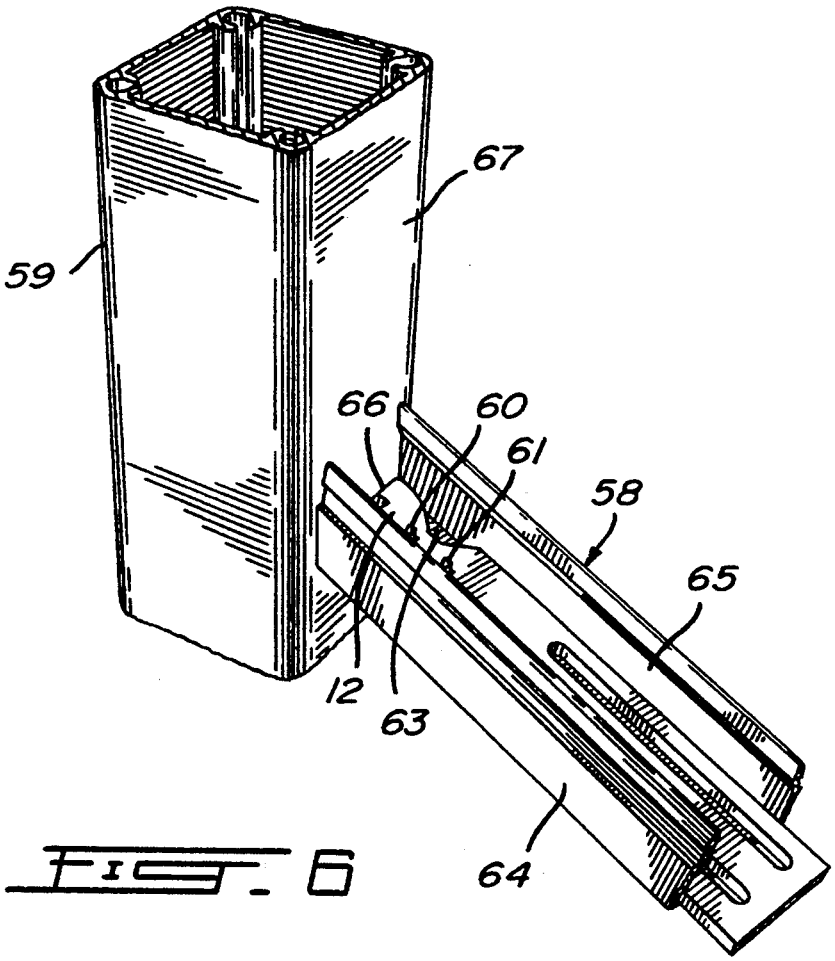
FIG. 6 is a perspective view of a fourth example of assembly of one end of an elongated rail to a hollow post by means of the device of FIG. 1.

Finally, FIG. 6 illustrates one end of an aluminum rail 58 secured to a hollow, tubular and vertical post square in cross section.

The elongated body 11 is first secured to the rail 58. This rail is U-shaped in cross section and formed with a flat bottom wall 63. The lower surface of the bottom wall 63 is formed with a pair of parallel flanges (not shown) defining a longitudinal channel for receiving the upper edge portion of a plate of tempered glass. The width of the elongated body 11 is selected to fit on the upper surface of the flat bottom wall 63 between the vertical walls 64 and 65 of the rail 58. Holes (not shown) are drilled through the flat wall 63 in the bottom of the channel. A pair of screws 60 and 61 pass through these two holes, respectively, and are driven in holes 15 and 16 to secure the body 11 to the rail 58.

An horizontal slot 66 is then made in the wall of the post 59. The end of the rail 58 is cut obliquely with respect to its longitudinal axis so that when the obliquely cut end of the rail 58 is applied to the outer surface 67 of the post 59 the rail 58 is oblique both vertically and horizontally with respect to the outer planar surface 67 of the square post 59. The portion of the head 12 extending from the end of the rail 58 is bent to enable insertion thereof in the slot 66. A screw (not shown is then inserted in the hole 21 of the head 12 to firmly apply the end of the rail 58 to the outer surface 67 of the post 59, in the same manner as described hereinabove in relation to screw 31 (FIGS. 2 and 3), 43 (FIG. 4) and 56 (FIG. 5).

One skilled in the art will appreciate that the concept of the present invention, consisting of inserting a flat head in a slot, increases the rail supporting surface and produces a better distribution of the charge applied to the rail.

One skilled in the art will also appreciate that the slot such as 30, 40 or 66, the semicircular edge surfaces 20 and 22 and the screw such as 31, 43 or 56 enable fast and precise assembly of the railing.

Although the present invention has been described hereinabove by way of a preferred embodiment thereof, this embodiment can be modified at will, within the scope of the appended claims, without departing from the spirit and nature of the subject invention.

What is claimed is:

1. A device for connecting one end of a generally elongated member to a hollow member formed with a slot therein, comprising:

first and second substantially flat sections separated by a pair of lateral shoulders;

said first section to be secured to said one end of the elongated member; and said second comprising between said lateral shoulders an outer semicircular edge surfaces extending over more than 180° and being formed with a hole defining an inner semicircular edge surface generally concentric with said outer semicircular edge surface, said second section to be inserted in said slot so that said second section extends at least partially inside said hollow member for enabling insertion, from the inside of said hollow member, of a fastener resting on both said inner semicircular edge surface and an inner surface of said hollow member to secure the second section in said slot and therefore said one end of the elongated ember to the hollow member.

2. A device as recited in claim 1, wherein said fastener comprises means for producing a pulling force that applies said one end of the elongated member to an outer surface of said hollow member.

3. A device as recited in claim 1, wherein said elongated member defines a longitudinal axis, said one end of the elongated member is cut obliquely with respect to said longitudinal axis, and said inner semicircular edge surface and said fastener form a mechanical connection that is adjustable to apply said obliquely cut end of the elongated member to an outer surface of said hollow member.

4. A device as recited in claim 1, wherein said second section is made of a material that can be bent.

5. A device as recited in claim 1, wherein said first section is elongated and comprises longitudinal slots for screwing it to said one end of the elongated member.

6. A device as recited in claim 1, wherein said device is one-piece device stamped from a metal plate.

7. A device as recited in claim 1, in which said lateral shoulders are slanted.

8. A device for connecting, in a railing, one end of a generally elongated rail member to a hollow post formed with a slot therein, comprising:

first and second substantially flat sections separated by a pair of lateral shoulders;

said first section to be secured to said one end of the rail member; and said second section comprising between said lateral shoulders an outer semicircular edge surface extending over more than 180° and being formed with a hole defining an inner semicircular edge surface generally concentric with said outer semicircular edge surface, said second section to be inserted in said slot so that said second section extends at least partially inside said hollow post for enabling insertion, from the inside of said hollow post, of a fastener in said hole, said fastener resting on both said inner semicircular edge surface and an inner surface of said hollow post to secure said second section in said slot and therefore said one end of the rail member to the hollow post.

9. A device as recited in claim 8, wherein said fastener comprises a screw having a head and a threaded elongated body, said screw being mounted in said hole with its head applied to the inner surface of the hollow post, and with its threaded elongated body applied to both the inner surface of the hollow post and said inner semicircular edge surface.

10. A device as recited in claim 8, wherein said second section is made of a material that can be bent.

11. A device as recited in claim 8, wherein said first section is elongated and comprises longitudinal slots for screwing it to said one end of the rail member.

12. A device as recited in claim 8, in which said lateral shoulders are slanted.

13. A system for connecting one end of a generally elongated member to a hollow member, comprising:

a slot in said hollow member;

a connection device including first and second substantially flat sections separated by a pair of lateral shoulders, said first section secured to said on end of the elongated member, and said second section comprising between said lateral shoulders and outer semicircular edge surface extending over more than 180° and being formed with a hole defining an inner semicircular edge surface generally concentric with said outer semicircular edge surface, said second section inserted in said slot to extend at least partially inside said hollow member; and a fastener mounted in said hole to rest on both said inner semicircular edge surface and an inner surface of said hollow member to thereby secure said second section in said slot and therefore said one end of the elongated member to said hollow member.

14. A system as recited in claim 13, wherein said fastener comprises a screw having a head and a threaded elongated body, said screw being mounted in said hole with its head applied to the inner surface of the hollow member, and with its threaded elongated body applied to both the inner surface of the hollow member and said inner semicircular edge surface.

15. A system for connecting, in a railing, one end of a generally elongated rail member to a hollow post, comprising:

a slot in said hollow post;

a connection device including first and second substantially flat sections separated by a pair of lateral shoulders, said first section secured to said one end of the rail member, and said second section comprising between said lateral shoulders and outer semicircular edge surface extending over more than 180° and being formed with a hole defining an inner semicircular edge surface generally concentric with said outer semicircular edge surface, said second section inserted in said slot to extend at least partially inside said hollow post; and a fastener mounted in said hole to rest on both said inner semicircular edge surface and an inner surface of said hollow post to thereby secure said second section in said slot and therefore said one end of the rail member to said hollow post.

16. A system as recited in claim 15, wherein said fastener comprises a screw having a head and a threaded elongated body, said screw being mounted in said hole with its head applied to the inner surface of the hollow post, and with its threaded elongated body applied to both the inner surface of the hollow post and said inner semicircular edge surface.

* * * * *